US008491081B2

(12) United States Patent
Leighton et al.

(10) Patent No.: US 8,491,081 B2
(45) Date of Patent: Jul. 23, 2013

(54) SYSTEM AND METHOD FOR COMPENSATING FOR ROLL ECCENTRICITY IN A PRINTER

(75) Inventors: Roger G. Leighton, Hilton, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 303 days.

(21) Appl. No.: 13/052,654

(22) Filed: Mar. 21, 2011

(65) Prior Publication Data

US 2012/0242730 A1 Sep. 27, 2012

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS

| | | | | |
|---|---|---|---|---|
| 4,903,067 | A | 2/1990 | Murayama et al. | |
| 4,990,767 | A | 2/1991 | Ernst et al. | |
| 5,193,918 | A | 3/1993 | Lohrmann et al. | |
| 5,287,160 | A | 2/1994 | Dastin et al. | |
| 5,412,302 | A | 5/1995 | Kido et al. | |
| 5,455,668 | A | 10/1995 | De Bock et al. | |
| 5,499,093 | A | 3/1996 | Aerens et al. | |
| 5,600,352 | A | 2/1997 | Knierim et al. | |
| 5,828,937 | A | 10/1998 | Aerens et al. | |
| 6,076,922 | A | 6/2000 | Knierim et al. | |
| 6,133,932 | A | 10/2000 | Webb et al. | |
| 6,215,119 | B1 | 4/2001 | Markham et al. | |
| 6,307,578 | B1 | 10/2001 | Castelli | |
| 6,330,424 | B1 | 12/2001 | Chapman et al. | |
| 6,374,076 | B1 | 4/2002 | Tanaka | |
| 6,407,678 | B1 | 6/2002 | Elgee et al. | |
| 6,823,786 | B1 | 11/2004 | Shmaiser et al. | |
| 7,085,508 | B2 | 8/2006 | Igarashi | |
| 7,126,621 | B2 | 10/2006 | Castelli et al. | |
| 7,168,478 | B2 * | 1/2007 | Edwards et al. | 164/480 |
| 7,245,862 | B2 | 7/2007 | Ebara | |
| 7,467,838 | B2 | 12/2008 | Folkins et al. | |
| 7,583,920 | B2 | 9/2009 | Willemsens et al. | |
| 7,587,157 | B2 | 9/2009 | Matsuda et al. | |
| 2003/0210932 | A1 | 11/2003 | Koide et al. | |
| 2006/0024104 | A1 | 2/2006 | Castelli et al. | |
| 2008/0088661 | A1 | 4/2008 | Folkins et al. | |
| 2008/0170111 | A1 | 7/2008 | Suzuki et al. | |
| 2008/0252710 | A1 | 10/2008 | Yasutani et al. | |
| 2010/0133738 | A1 | 6/2010 | Kawachi et al. | |
| 2011/0063357 | A1 * | 3/2011 | Eun et al. | 347/17 |

OTHER PUBLICATIONS

US 7,673,987, 3/2010, Von Essen et al. (withdrawn).
Do, An H, Non-final Office Action for U.S. Appl. No. 12/561,987, mailed Nov. 16, 2011 (5 pages).
Lockman, David M., Response to Non-final Office Action for U.S. Appl. No. 12/561,987, submitted Dec. 31, 2011 (8 pages).

* cited by examiner

*Primary Examiner* — Stephen Meier
*Assistant Examiner* — Tracey McMillion
(74) *Attorney, Agent, or Firm* — Maginot, Moore & Beck, LLP

(57) ABSTRACT

A printer includes a plurality of a plurality of printheads and a plurality of rolls positioned opposite the printheads along a media path in the printer. Print media contact and move over the rolls as the printheads eject ink onto the print media moving along the media path. A controller is configured to generate a signal to operate a printhead with reference to an angular position of a roll positioned opposite to the printhead that receives the signal to compensate for flight time errors due to backer roll eccentricity.

14 Claims, 4 Drawing Sheets

SYSTEM AND METHOD FOR COMPENSATING FOR ROLL ECCENTRICITY IN A PRINTER

TECHNICAL FIELD

This disclosure relates generally to systems and methods that compensate for the rotational eccentricity of a roll in a printer, and more particularly to systems and methods for compensating for eccentricities in rolls that contact media in printers that control printhead firings with a single or dual reflex registration system.

BACKGROUND

In general, inkjet printing machines or printers include at least one printhead unit that ejects drops of liquid ink onto recording media or an imaging member for later transfer to media. Different types of ink may be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets quickly solidify.

The media used in both direct and offset printers may be in web form. In a web printer, a continuous supply of media, typically provided in a media roll, is entrained onto rolls that are driven by motors. The motors and rolls pull the web from the supply roll through the printer to a take-up roll. The rollers are arranged along a linear media path, and the media web moves through the printer along the media path. As the media web passes through a print zone opposite the printhead or heads of the printer, the printheads eject ink onto the web. Along the feed path, tension bars or other rolls remove slack from the web so the web remains taut without breaking.

Existing web printing systems use a registration control method to control the timing of the ink ejections onto the web as the web passes the printheads. One known registration control method that may be used to operate the printheads is the single reflex method. In the single reflex method, the rotation of a single roll at or near a printhead is monitored by an encoder. The encoder may be a mechanical or electronic device that measures the angular velocity of the roll and generates a signal corresponding to the angular velocity of the roll. The angular velocity signal is processed by a controller executing programmed instructions for implementing the single reflex method to calculate the linear velocity of the web. The controller may adjust the linear web velocity calculation by using tension measurement signals generated by one or more load cells that measure the tension on the web near the roll. The controller implementing the single reflex method is configured with input/output circuitry, memory, programmed instructions, and other electronic components to calculate the linear web velocity and to generate the firing signals for the printheads in the marking stations.

Another existing registration control method that may be used to operate the printheads in a web printing system is the double reflex method. In the double reflex method, each encoder in a pair of encoders monitors one of two different rolls. One roll is positioned on the media path prior to the web reaching the printheads and the other roll is positioned on the media path after the media web passes the printheads. A controller executing programmed instructions implements the double reflex registration method. The controller receives angular velocity signals generated by the two encoders for the two rolls, processes the signals to calculate the linear velocity of the web at each roll, and interpolates the linear velocity of the web at each of the printheads from the calculated velocities. These additional calculations enable better timing of the firing signals for the printheads in the marking stations and, consequently, improves registration of the images printed by the marking stations in the printing system.

Moving the web through the media path in a controlled manner presents challenges to web printing systems. Once such challenge occurs when a print medium moves past one or more marking stations in a print zone. As the print medium moves past each marking station, the marking station ejects ink drops onto the print medium to form images. As described above, operation of the marking stations to eject ink drops is regulated by the registration control method. Ink drops ejected from each marking station take a certain amount of time, referred to as a "flight time," to reach the print medium. As the print medium moves past each marking station, variations in the distance between the print medium and the marking station affect the flight time of ink drops. Since the media web is in motion, often at speeds on the order of tens or hundreds of inches per second, variations in flight time of the ink drop may result in the ink drop landing on the print medium in an incorrect location, also known as a registration error. Registration errors negatively affect image quality in printed documents.

Some web printer systems position a roll, referred to as a backer roll, at a fixed distance opposite each marking station in the web printer. During an imaging operation, the print medium contacts each backer roll to ensure that the distance between the print medium and the marking station remains substantially constant. The backer rolls rotate to enable the media web to move through the print zone. Each backer roll requires fine tolerances and calibration to ensure that the media web remains at a constant distance from the corresponding marking station. The required tolerances increase the manufacturing costs of the backer rolls, and may require additional maintenance to ensure that the backer rolls remain within tolerance during operation of the printer. Consequently, improvements to printing systems that enable the use of rotating members, including backer rolls, with wider tolerances while maintaining image quality are beneficial.

SUMMARY

In one embodiment, a printer has been developed. The printer includes a plurality of printheads positioned along a media path in the printer, a plurality of rolls positioned opposite the plurality of printheads along the media path to support media contacting and moving over the rolls in the plurality of rolls as the printheads eject ink onto the media moving along the media path, and a controller operatively connected to the plurality of printheads to operate the printheads selectively to eject ink, the controller being configured to generate a signal to operate a printhead in the plurality of printheads with reference to an angular position of a roll opposite the printhead.

In another embodiment, a method for operating a printer has been developed. The method includes moving media over a plurality of rolls in the printer, generating signals to operate printheads in a plurality of printheads to eject ink onto the media moving over the plurality of rolls, and adjusting a delivery time for a signal generated to operate one of the printheads in the plurality of printheads with reference to a change in distance between the one printhead and the roll in the plurality of rolls opposite the one printhead.

DETAILED DESCRIPTION

Figure 1:
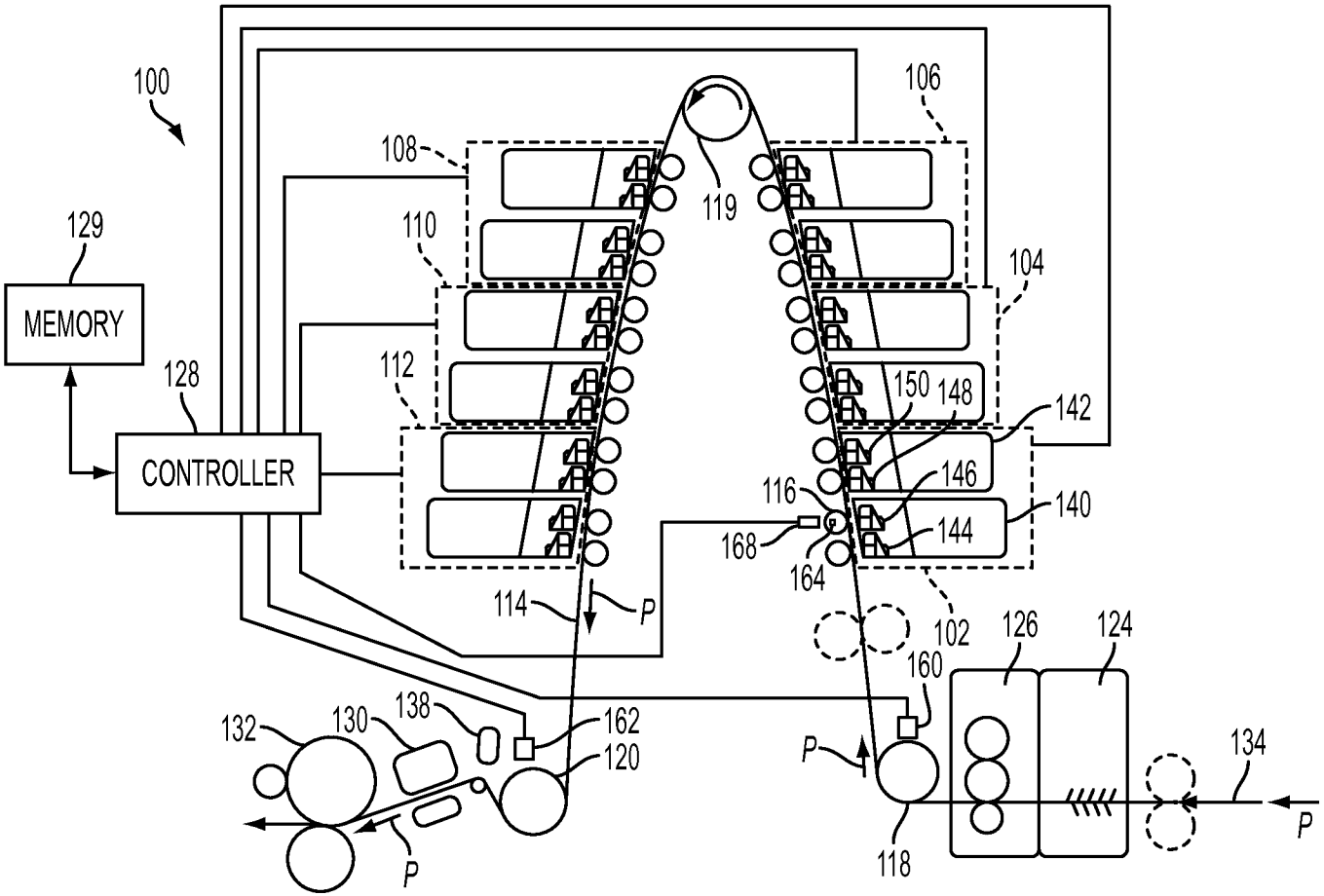
FIG. 1 is a schematic diagram of a continuous web printing system that is configured to identify registration errors due to eccentricities in one or more backer rolls, and to apply a timing offset to ink drop ejection to correct the registration errors.

For a general understanding of the environment for the system and method disclosed herein as well as the details for the system and method, the drawings are referenced throughout this document. In the drawings, like reference numerals designate like elements. As used herein the term "printer" refers to any device that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member. As used herein, the terms "web," "media web," and "continuous media web" refer to an elongated print medium that is longer than the length of a media path that the web traverses through a printer during the printing process. Examples of media webs include rolls of paper or polymeric materials used in printing. The media web has two sides forming surfaces that may each receive images during printing. Each surface of the media web is made up of a grid-like pattern of potential drop locations, sometimes referred to as pixels.

As used herein, the term "eccentricity" refers to a time-varying non-uniformity in the distance between the surface of a cylindrical object that rotates on a longitudinal axis, such as a roll in a printer, and a fixed location outside of the cylinder as the cylinder rotates. A roll in a printer that has an "eccentric" shape or configuration exhibits eccentricity when rotated. An eccentric roll may have a central rotating axis that is offset from the geometric center of the roll. An eccentric roll may also have a cross-sectional shape that is non-circular, such as an elliptical shape or a non-uniform shape.

The terms "time offset" and "timing offset" are interchangeable and refer to an amount of time used to adjust activation of a printhead to eject one or more ink drops from the printhead. When the printhead is configured to eject the ink drops at a first time, a control mechanism may apply the time offset to change the time at which the printhead ejects the ink drops to be either an earlier time or a later time than the first time. A magnitude of the time offset determines how much earlier or later than the first time the printhead ejects the ink drops. The process-direction registration of ink drops on an image receiving member may be changed by applying a time offset to change the time at which a printhead ejects ink drops.

FIG. 1 depicts a continuous web printer system 100 that includes six print modules 102, 104, 106, 108, 110, and 112; a media path P configured to accept a print medium 114, a controller 128, a memory 129, image on web array (IOWA) sensor 138, and encoders 160 and 162. The print modules 102, 104, 106, 108, 110, and 112 are positioned sequentially along a media path P and form a print zone for forming images on a print medium 114 as the print medium 114 travels past the print modules. The media web travels through the media path P guided by a pre-heater roll 118, backer rolls exemplified by backer roll 116, an apex roll 119, and a leveler roll 120. A brush cleaner 124 and a contact roll 126 are located at one end of the media path P. A heater 130 and a spreader 132 are located at the opposite end 136 of the media path P. The controller 128 is configured to monitor the positions of the backer rolls 116 and to control the timing of ink ejection from the print modules 102-112 with respect to the angular position of backer rolls that are opposite each print module.

In printing system 100, each print module 102, 104, 106, 108, 110, and 112 in this embodiment provides an ink of a different color. In all other respects, the print modules 102, 104, 106, 108, 110, and 112 are substantially identical. Print module 102 includes two print sub modules 140 and 142. Print sub module 140 includes two print units 144 and 146. The print units 144 and 146 each include an array of printheads that may be arranged in a staggered configuration across the width of both the first section of web media and second section of web media. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path P at a predetermined resolution.

In the example of FIG. 1, print sub module 140 is configured to emit ink drops in a twenty inch wide path that includes both the first and second sections of the media web at a resolution of 300 dots per inch. Ink ejectors in each printhead in print units 144 and 146 are configured to eject ink drops onto predetermined locations of both the first and second sections of media web 114. A single backer roll is positioned opposite the printheads in each of the staggered print units 144 and 146, with backer roll 116 being positioned opposite the printheads in print unit 146 by way of example. Print module 102 also includes sub module 142 that has the same configuration as sub module 140, but has a cross-process alignment that differs from sub module 140 by one-half of a pixel. This enables printing system 100 to print with twice the resolution as provided by a single print sub module. In the example of FIG. 1, sub modules 140 and 142 enable the printing system 100 to emit ink drops with a resolution of 600 dots per inch. As illustrated, a backer roll is positioned opposite each set of printheads in each of the sub modules in the printing system 100.

Controller 128 is configured to control various subsystems, components and functions of printing system 100. The controller 128 may be implemented with general or specialized programmable processors that execute programmed instructions. Controller 128 is operatively connected to memory 129 to enable the controller 128 to read instructions and read and write data required to perform the programmed functions in memory 129. Memory 129 also holds one or more reference tables that include ink drop time offset values for each print unit in each printing module in the printing system 100. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Controller 128 is operatively coupled to the print modules 102-112 and controls the timing of ink drop ejection from the print modules 102-112 onto the media web 114. Controller 128 is also operatively coupled to the IOWA sensor 138 to detect the process and cross-process positions of ink drops on the media web 114 after the ink drops are ejected from the print modules 102-112. Controller 128 is also operatively connected to roll velocity sensors 160 and 162 that enable the controller 128 to identify linear speed of the media web 114 for double reflex printing (DRP). The embodiment of FIG. 1 also shows controller 128 operatively connected to one or more sensors, such as Hall effect sensor 168.

The IOWA sensor 138 is a full width image contact sensor, which monitors the ink on the web 114 as the web 114 passes under the IOWA sensor 138. In the embodiment of FIG. 1, IOWA sensor 138 is operatively connected to the controller 128. Light reflects from locations on the web 114 having ink at a first level, and the light reflects from locations on the web 114 that do not have ink at a second, different level. In one embodiment where the media web 114 is white paper and the print modules 102-112 emit inks having various colors, light reflects from ink on the media web 114 at a lower level than light reflected from bare portions of the media web 114. In the embodiment of FIG. 1, the controller 128 may identify a time at which the IOWA sensor 138 senses light reflected from a particular printed mark on the media web.

FIG. 1 depicts backer roll 116 positioned opposite the print unit 146 and in contact with the media web 114. Backer roll 116 is configured to rotate as the media web 114 travels in process direction P. The media web 114 contacts the backer roll 116 and the backer roll 116 is configured to maintain a uniform distance between the media web 114 and each of the printheads in the print unit 146. A sensor is operatively coupled to the backer roll 116 to enable the controller 128 to identify the angular velocity and angular position of the backer roll 116. In the example of FIG. 1, a marker, seen here as magnet 164, is embedded in one end of the backer roll 116. A Hall effect sensor 168 is positioned proximate to the end of the backer roll 116 with the embedded magnet 162, and the sensor 168 is operatively connected to the controller 128. The Hall effect sensor 168 generates a signal each time the magnet 164 passes the Hall effect sensor 168 as backer roll 116 rotates. Alternative marker and sensor embodiments include optical wheel sensors, mechanical rotation sensors, and any sensor that enables the controller 128 to identify the angular velocity and angular position of the backer roll 116. In printing system 100, a backer roll similar to backer roll 116 is positioned opposite each print unit in each of the print modules 102, 104, 106, 108, 110, and 112. While FIG. 1 depicts a single backer roll 116 coupled to marker 162 and sensor 168 for clarity, each of the backer rolls in the printing system 100 is coupled to a marker, sensor, and the control 128 in the same manner as backer roll 116.

The controller 128 identifies the angular velocity of the backer roll 116 based on the frequency of signals generated by the Hall effect sensor 168. The controller 128 may also identify the angular position of the roll 116 based on an identified rotational period and a measurement of the amount of time since the rotational period began. For example, controller 128 receives signals from the Hall effect sensor 168 at an interval of 0.075 seconds, and identifies that the backer roll 116 has a rotational period of 0.075 seconds, for a rotational rate of 800 rotations per minute (RPM). The controller 128 measures a time period that has elapsed since the previous signal from the Hall effect sensor 168 to identify an angular position of the backer roll 116. In the example where the roll 116 has a rotational period of 0.075 seconds, the backer roll rotates approximately 90° after 0.01875 seconds, approximately 180° after 0.0375 seconds, and approximately 270° after 0.05625 seconds from the time that the Hall effect sensor 168 generates a signal. The controller 128 may divide the rotational period into a predetermined number of segments to identify the angular position of the backer roll 116 with varying degrees of precision. The roller rotational speed is generated by the traction due to the tension in the web, the roughness of the paper surface and roll, and web speed. The traction is sufficient to overcome the bearing friction and loss of friction due to air entrainment at high speeds. To account for a small amount of slip that may occur between the backer roll and the media web for each revolution of the roll, the controller 128 may apply a correction factor to the angular position of the backer roll 116. The eccentricity of the backer roll 116 does not change with respect to the Hall effect position, but the identified angular position of the backer roll is adjusted to correct for registration errors that may be introduced by the slip between the backer roll and the web.

Figure 2A:
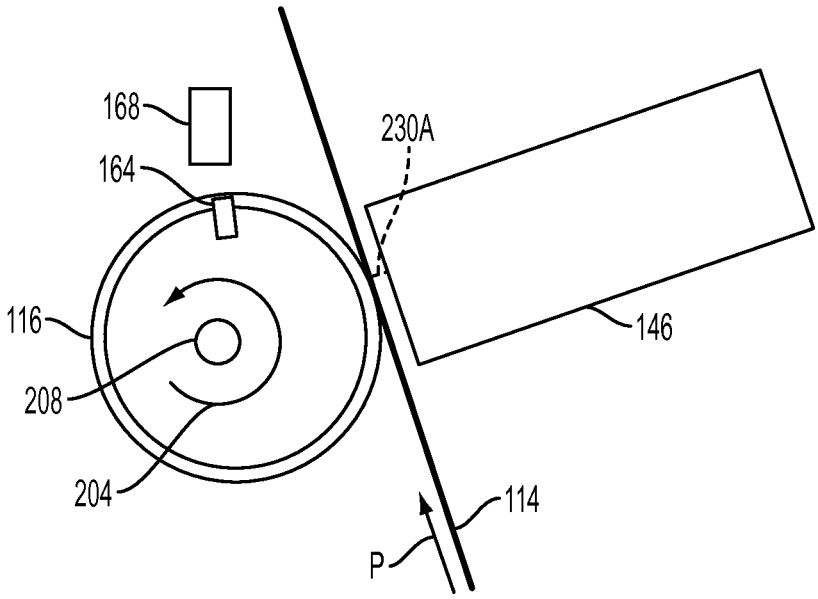
FIG. 2A is a schematic diagram of a backer roll at a first angular position.
Figure 2B:
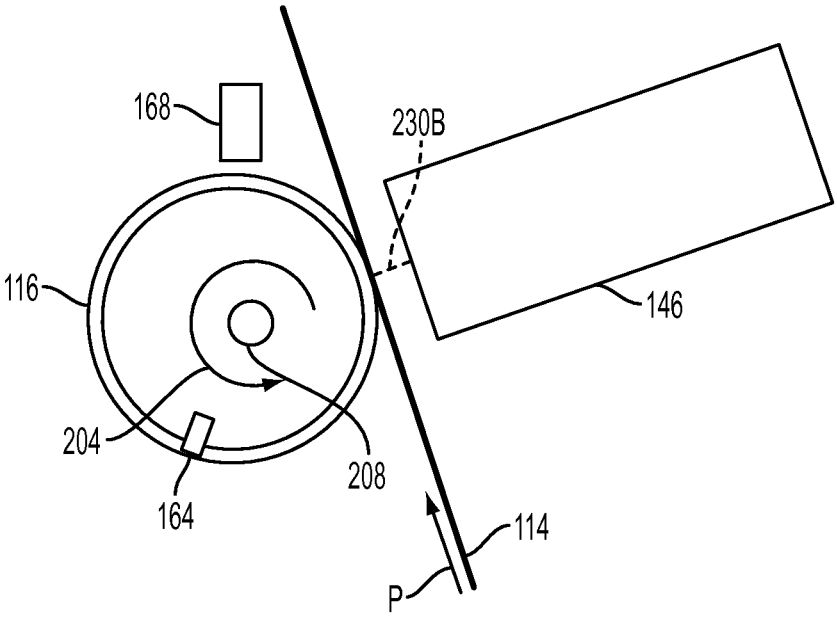
FIG. 2B is a schematic diagram of the backer roll of FIG. 2A at a second angular position.

As shown in FIG. 2A and FIG. 2B, the backer roll 116 may have an eccentric rotational form that enables a distance between printheads in the print unit 146 and the media web 114 to change as the backer roll 116 rotates. FIG. 2A depicts backer roll 116 in a first position as the backer roll 116 rotates longitudinally around an axle 208 in direction 204. Media web 114 moves between the backer roll 116 and the print unit 146 in process direction P. In the angular position of FIG. 2A, the print unit 146 is separated from the media sheet 114 by distance 230A. FIG. 2B depicts backer roll 116 in a different rotational position as the backer roll rotates in direction 204. Due to a rotational eccentricity in the backer roll 116, the distance 230B between the media web 114 and the print unit 146 is greater than the distance 230A seen in FIG. 2A. As the backer roll 116 rotates, magnet 164 passes Hall effect sensor 168, enabling the controller 128 seen in FIG. 1 to identify the angular velocity and angular position of the backer roll 116.

Print unit 146 ejects ink drops onto the media web 114 at a substantially constant velocity. Consequently, the amount of time that an ink drops take to reach the media web 114 in the configuration of FIG. 2A is less than in the configuration of FIG. 2B. Since the media web 114 is moving in process direction P, the distance that the media web 114 moves as the ink drop travels toward the media web 114 varies based on the angular position of the backer roll 116 at the time the ink drop is ejected. Thus, the process-direction location of where ink drops land on the media web 114 is affected by the angular position of the backer roll 116 at the time the ink drop is ejected. As described below, the printing system 100 is configured to identify process direction errors introduced by the eccentricity of the roll 116, and to adjust the time at which corresponding print units such as print unit 146 emit ink drops to compensate for the errors. The registration errors are measured by the IOWA sensor 138. The IOWA sensor 138 generates a target image of the media web 114, and the controller 128 calculates the spatial error due to the backer roll eccentricities from the target image data. The Hall effect sensor 168 provides a reference by which the eccentricity compensation table is constructed in memory 129. In one configuration, the backer roll position is updated every 75 ms in case slip occurs between the web and paper to reduce errors in identifying the angular position of the backer roll.

Figure 3:
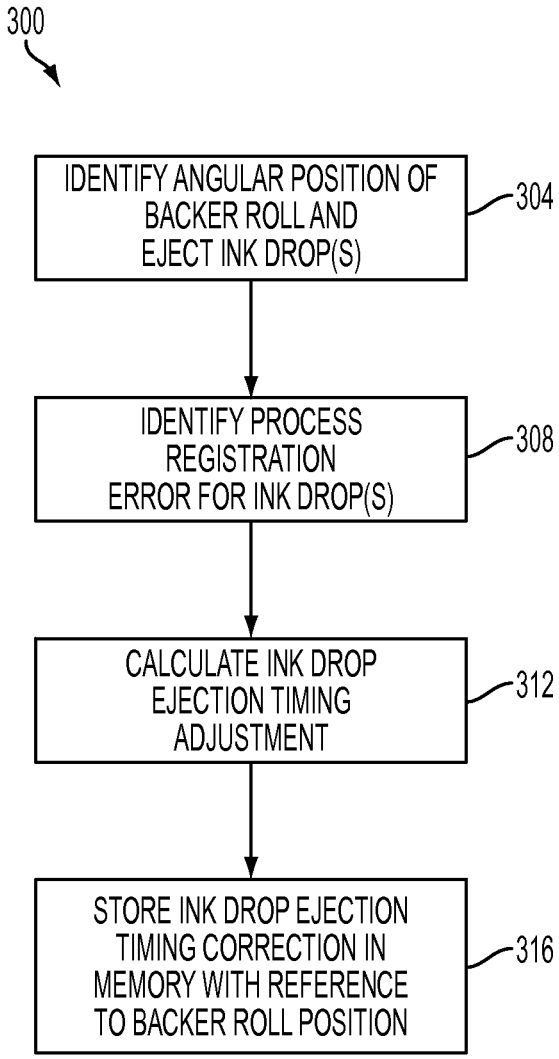
FIG. 3 is a flow diagram of a method for identifying registration errors introduced by eccentricity in the backer rolls.
Figure 4:
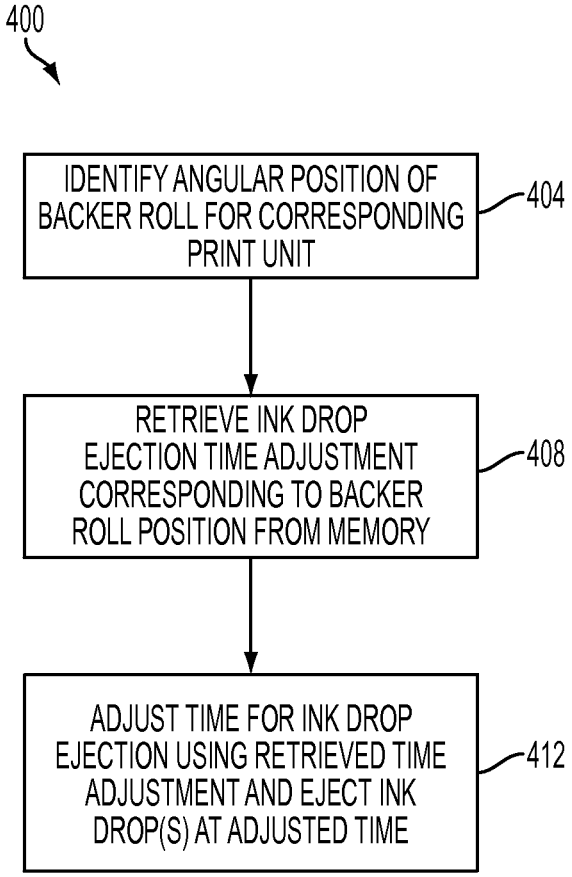
FIG. 4 is a flow diagram of a method for applying a timing offset to ink drop ejection to compensate for the registration errors introduced by eccentricity in the backer rolls.

In operation, controller 128 is configured to identify errors in the process-direction registration of ink drops emitted from the print modules 102-112 introduced by eccentricities of the backer rolls 116, and to adjust the timing of ink drop ejection from the print modules 102-112 to correct for the identified errors. FIG. 3 describes a process 300 for identifying registration errors caused by backer roll eccentricity that is suitable for use in the printing system 100. FIG. 4 describes a process 400 for adjusting the timings of one or more print modules 102-112 in the printing system 100 to correct for the identified errors.

FIG. 3 depicts a process 300 for identifying errors in process registration of ink drops due to backer roll eccentricity, and for generating timing correction values to compensate for the identified errors. Process 300 begins by identifying an angular position of a backer roll and ejecting one or more ink drops from a print unit that is positioned opposite the backer roll (block 304). Using printing system 100 as an example, controller 128 may measure the angular position of backer roll 116 based on the signals generated by Hall effect sensor 168 as the backer roll 116 and magnet 164 rotate. The controller 128 divides the rotational path of backer roll 116 into a predetermined number of segments, and the angular position is identified with respect to one of the segments. In one example embodiment, the rotational path is divided into eight (8) segments where each segment corresponds to 45° of rotation, although more or fewer segments may be used. The controller 128 operates print unit 146 positioned opposite the roll 116 to eject one or more ink drops concurrently with the identification of the angular position of the backer roll 116. The ink drops may be arranged in a predetermined "test pattern" that is selected to enable accurate detection of the ink drops on the media web 114 by the IOWA sensor 138. In the example of FIG. 1, each printhead in the print unit 146 emits one or more ink drops onto the media web 114.

Process 300 identifies process-direction registration errors in the location of the ink drops on the media web caused by eccentricity in the backer roll (block 308). In the example printing system 100, controller 128 identifies the process direction errors using signals generated by the IOWA sensor 138. Thus, the IOWA sensor 138 generates signals corresponding to the measured variation between the expected position of ejected ink drops and the measured position of the ink drops in the process direction. For example, if the eccentricity of the roll 116 places the media web 114 at a distance to print unit 146 that is closer than the expected distance, IOWA sensor 138 detects the ink drops on the media web 114 ahead of the expected position for the ink drops in the process direction. Similarly, if the media web 114 is farther from the print unit 146 than expected, the IOWA sensor 138 detects the ink drops behind the expected position for the ink drops in the process direction.

Controller 128 measures the linear velocity of the media web 114 through the media path P using signals generated by sensors 160 and 162. The controller 128 may generate a time offset measurement by dividing the variation in drop position measured by the IOWA sensor 138 by the measured speed of the media web 114. Process 300 calculates a timing offset value for changing the time at which the print unit 146 ejects ink drops (block 312). In the example embodiment of process 300, the controller 128 calculates the timing offset value using the following equation:

$$T_{off}=(P_{actual}-P_{expected})/V_{web}$$

Where $P_{actual}$ and $P_{expected}$ are actual and expected positions, respectively, at which the IOWA sensor 138 detects the ink drops in process block 308. The processor 128 identifies the relative process direction positions $P_{actual}$ for each of the predetermined rotational segments of the backer roll 116. The ink drops ejected by the print unit 146 land at the most rearward position $P_{actual}$ on the media web 114 in the process direction P when the rotational position of the backer roll 116 is at the position farthest from the print unit 146. This position is selected as the expected location $P_{expected}$ for ink drops ejected from printheads in the print unit 146. The calculated $T_{off}$ for the all the other angular positions of the backer roll 116 is then a positive time delay value with respect to the expected location.

In another embodiment, the units used to measure $P_{actual}$ and $P_{expected}$ enable either a positive or negative result for the value of $T_{off}$ with respect to the predetermined firing time for the printhead. In one example configuration, a negative value for $T_{off}$, indicates that $P_{actual}$ is ahead of $P_{expected}$ in the process direction, and controller 128 delays the ejection ink drops from the corresponding print unit 146 by the value of $T_{off}$ when the backer roll 116 is in the identified angular position. When $T_{off}$ is a positive value, the controller 128 operates the corresponding print unit 146 to bring the time of ejection of ink drops forward by the value of $T_{off}$ when the backer roll 116 is in the identified angular position. In another embodiment, the relative signs for $P_{actual}$ and $P_{expected}$ are reversed.

Controller 128 stores the $T_{off}$ value in memory 129 (block 316). The controller 128 stores the $T_{off}$ value in the memory 129 with reference to the print unit that is being operated, the identified angular position of the backer roll corresponding to the operated print unit, and the operating speed of the media web 114. As described in FIG. 4, the $T_{off}$ value may then be retrieved during imaging operations to adjust the timing of ink drop ejection from the corresponding print unit. Alternative embodiments of process 300 may store measured values other than the time offset value $T_{off}$. For example, a controller may store a linear measurement of the measured registration error introduced by the roll eccentricity, and adjust the operation of the printing system to correct for the measured linear error.

Process 300 repeats process blocks 304-316 a predetermined number of times for a single backer roll in different angular positions to identify process registration errors and calculate timing offsets for the backer roll as the backer roll rotates. For example, the controller 128 may perform blocks 304-316 for backer roll 116 in eight different segments with each segment covering a 45° angle to generate eight timing offset values that correspond to the eight angular segments as the backer roll 116 rotates. Process 300 is also conducted for each backer roll and corresponding print unit in the printing system 100 to generate timing offsets for each print unit in the printing system 100.

Process 300 may be conducted multiple times to identify registration errors and to generate timing offsets for different linear speeds of the media web 114. During operation of a printing system, such as printing system 100, the tolerances of one or more backer rolls may change due to various factors including mechanical wear and temperature variations. Thus, process 300 is carried out periodically to account for changes in the errors introduced by backer roll eccentricity. While process 300 as shown identifies errors in image registration due to roll eccentricity by identifying errors in the position of ink drops on the media web, an alternative embodiment may generate direct measurements of the distance between a backer roll and a corresponding print unit at various angular positions for the backer roll. For example, a laser range finding sensor may measure the distance between the print unit and the backer roll at different angular positions for the backer roll. In this embodiment, the printheads in each print unit are configured to be a predetermined distance from a corresponding backer roll, and the ink drops are ejected from the printheads with a predetermined velocity. The controller generates a time offset value by dividing the difference between the expected distance and the measured distance by the velocity of ejected ink drops, and stores the time offset in memory.

FIG. 4 depicts a process 400 for adjusting the timing of ink drop ejection from a print unit in a printing system to compensate for registration errors due to backer roll eccentricity. Using the example of printing system 100, the controller 128 is configured to fire ink ejectors in some or all of the of the printing units in the print modules 102-112 to form ink images on the media web 114 during imaging operations. The controller 128 is configured to send firing signals to the corresponding ink ejectors in the printing units at predetermined times so that the ink drops land in predetermined pixel locations on the image web 114 to form the image. As described above in process 300, the controller 128 also identifies any registration errors introduced by the eccentricities of the backer rolls in the printing system and stores timing offset values for different angular positions of each backer roll in memory 129.

During an imaging operation, the controller 128 identifies the position of a backer roll corresponding to a print unit that ejects one or more ink drops during the imaging operation (block 404). Using one example from printing system 100, backer roll 116 rotates with the media web 114 as the corresponding print unit 146 ejects ink drops onto the media web 114. Controller 128 identifies the angular position of the backer roll 116 with reference to signals from the Hall effect sensor 168 as described above. In embodiments where the value of $T_{off}$ advances the timing of the ejection of ink drops, the controller 128 may first identify the position of the backer roll 116 prior to the predetermined time for the ejection of ink drops from the print unit 146. The controller then estimates the position of the backer roll 116 at the time when the print unit 146 ejects the ink drops with reference to the identified rotational velocity of the backer roll 116. Estimating the position of the backer roll 116 enables the controller 128 to advance the time for ink drop ejection from the print unit 146 to an earlier time. This timing advanced is needed if the time offset value for the identified rotational position of the backer roll 116 indicates that the print unit should eject ink drops at an earlier time to compensate for eccentricity in the backer roll 116.

Once the controller 128 identifies the angular position of the backer roll 116, the controller 128 retrieves a timing offset value corresponding to the print unit 146, the identified angular position of backer roll 116, and the linear speed of the media web 114 during the printing operation (block 408). The timing offset value $T_{off}$ stored in the memory 129 during process 300 is retrieved to offset the time for ejecting one or more drops of ink ejected from printheads in the print unit 146.

Controller 128 adjusts the timing of ink drop ejection from the print unit 146 using the retrieved time offset value (block 412). In one embodiment, print unit 146 receives electronic firing signals from the controller 128 and ejects ink drops in response to receiving the firing signals. The controller 128 may either delay the generation of the firing signals, or bring the firing signal generation forward in time in accordance with the retrieved value of $T_{off}$. The timing offset to the generation of the firing signals and corresponding timing offset to the ejection of ink drops from the print unit 146 compensates for registration errors due to eccentricity in the rotation of the backer roll 116, and improves the quality of the ink images generated in the imaging operation.

During an imaging operation, process 400 adjusts the times for ink drop ejection for each of the print units in print modules 102-112 that eject ink drops during the imaging operation. When a print unit ejects ink drops at different times during the imaging operation, the controller 128 may retrieve different timing offsets for the print unit based on different identified rotational positions of a corresponding backer roll as the media web moves through the print zone.

It will be appreciated that variants of the above-disclosed and other features and functions, or alternatives thereof, may be desirably combined into many other different systems, applications or methods. For example, while the embodiments disclosed herein depict a continuous media web printing system, the foregoing techniques may also be applied cut-sheet printing devices. Additionally, the foregoing systems and techniques may be applied to any rotating member that receives ink drops, including a rotating image drum used in indirect ink jet printing devices. Various presently unforeseen or unanticipated alternatives, modifications, variations or improvements may be subsequently made by those skilled in the art that are also intended to be encompassed by the following claims.

What is claimed:

1. A printer comprising:

a plurality of printheads positioned along a media path in the printer;

a plurality of rolls positioned opposite the plurality of printheads along the media path to support media contacting and moving over the rolls in the plurality of rolls as the printheads eject ink onto the media moving along the media path; and a controller operatively connected to the plurality of printheads to operate the printheads selectively to eject ink, the controller being configured to generate a signal to operate a printhead in the plurality of printheads with reference to an angular position of a roll opposite the printhead, and to identify an angular position of the roll opposite the printhead for which the signal to operate the printhead is being generated, to generate the signal to operate the printhead to eject an ink drop onto a print medium while the roll opposite the printhead is in the identified angular position, and to identify a difference between a measured process direction position of the ink drop on the print medium and an expected process direction position of the ink drop on the print medium.

2. The printer of claim 1, the plurality of rolls further comprising:

a plurality of markers, each marker in the plurality of markers being located in one end of a roll in the plurality of rolls so each roll has only one marker in one end; and a plurality of sensors, each sensor in the plurality of sensors being proximate a roll in the plurality of rolls so each roll in the plurality of rolls has only one sensor proximate the roll, each sensor being configured to generate a signal once during each revolution of the roll proximate the sensor in response to detection of the marker in the one end of the roll by the sensor.

3. The printer of claim 2 wherein each sensor is operatively connected to the controller and the controller is configured to identify a time offset for generating the signal to operate the printhead with reference to the signal generated by the sensor proximate the roll opposite the printhead.

4. The printer of claim 1 further comprising:

a memory operatively connected to the controller; and the controller being further configured to:

identify a time offset for delivery of the signal generated to operate the printhead with reference to the identified difference between the measured process direction position of the ink drop on the print medium and the expected process direction position of the ink drop on the print medium; and store the identified time offset in the memory with reference to the angular position of the roll opposite the printhead configured to receive the generated signal.

5. The printer of claim 4, the controller being further configured to:

identify a velocity of the print medium;

identify the time offset with reference to the identified velocity of the print medium; and store the identified time offset in the memory with reference to the identified velocity.

6. A printer comprising:

a plurality of printheads positioned along a media path in the printer;

a plurality of rolls positioned opposite the plurality of printheads along the media path to support media contacting and moving over the rolls in the plurality of rolls as the printheads eject ink onto the media moving along the media path; and a controller operatively connected to a memory; and the plurality of printheads to operate the printheads selectively to eject ink, the controller being configured to generate a signal to operate a printhead in the plurality of printheads with reference to an angular position of a roll opposite the printhead and to identify a change in distance between the printhead and the roll opposite the printhead with reference to an angular position of the roll opposite the printhead and a registration error at the angular position of the roll opposite the printhead that is stored in the memory.

7. The printer of claim 6, the controller being further configured to identify a time offset for delivery of the signal generated to operate the printhead, the time offset being identified with reference to a difference between a predetermined distance between the printhead and the roll opposite the printhead and a distance identified with reference to the angular position of the roll opposite the printhead and the registration error divided by a media velocity.

8. A method for operating a printer comprising:

moving media over a plurality of rolls in the printer;

generating signals to operate printheads in a plurality of printheads to eject ink onto the media moving over the plurality of rolls; and adjusting a delivery time for a signal generated to operate one of the printheads in the plurality of printheads with reference to a change in distance between the one printhead and the roll in the plurality of rolls opposite the one printhead.

9. The method of claim 8 further comprising:

identifying an angular position of each roll in the plurality of rolls as the media moves over the plurality of rolls; and the identification of the change in distance between the one printhead and the roll opposite the one printhead being made with reference to the identified angular position of the roll opposite the one printhead and an error associated with the identified angular position.

10. The method of claim 9, the identification of the angular position of the roll in the plurality of rolls opposite the one printhead further comprising:

detecting a marker located in an end of the roll; and generating a signal indicating detection of the marker during each revolution of the roll.

11. The method of claim 9 further comprising:

retrieving from a memory an eccentricity error associated with the identified angular position of the roll.

12. The method of claim 11, the adjustment of the delivery time for the signal generated for the one printhead further comprising:

identifying a delay for the delivery of the signal generated for the one printhead with reference to a difference between a predetermined distance between the one printhead and the roll opposite the one printhead and a distance identified with reference to the eccentricity error retrieved for the identified angular position of the roll divided by an ink drop velocity.

13. The method of claim 9 further comprising:

retrieving from a memory a registration error associated with the identified angular position of the roll.

14. The method of claim 13, the adjustment of the delivery of the signal generated for the one printhead further comprising:

identifying a delay for the delivery of the signal generated for the one printhead with reference to a difference between a predetermined distance between the one printhead and the roll opposite the one printhead and a distance identified with reference to the registration error retrieved for the identified angular position of the roll divided by an ink drop velocity.

* * * * *